United States Patent [19]

Lindahl et al.

[11] Patent Number: 4,578,147

[45] Date of Patent: Mar. 25, 1986

[54] PROCESS FOR MANUFACTURING GROUNDWOOD PULP WHILE MAINTAINING A HIGH AND UNIFORM MOISTURE CONTENT IN THE WOOD IN THE GRINDING ZONE

[75] Inventors: Jonas A. I. Lindahl, Domsjo; Gustaf E. Johnsson, Umea, both of Sweden

[73] Assignee: Mo och Domsjo Aktiebolag, Ornskoldsvik, Sweden

[21] Appl. No.: 470,903

[22] Filed: Mar. 1, 1983

Related U.S. Application Data

[63] Continuation of Ser. No. 281,433, Jul. 8, 1981, abandoned.

[30] Foreign Application Priority Data

Jul. 9, 1980 [SE] Sweden ..... 8005035

[51] Int. Cl.[4] ..... D21C 1/12; D21C 1/16

[52] U.S. Cl. ..... 162/26; 162/28; 241/21; 241/28

[58] Field of Search ..... 241/21, 28; 162/24, 162/25, 26, 27, 28, 20

[56] References Cited

U.S. PATENT DOCUMENTS

| | | | |
|---|---|---|---|
| 1,633,733 | 6/1927 | Fish, Jr. | 241/28 |
| 2,050,749 | 8/1936 | Mers | 241/28 |
| 3,690,568 | 9/1972 | Alexander | 241/28 |
| 4,017,356 | 4/1977 | Bystedt | 162/26 |

*Primary Examiner*—Steve Alvo

[57] ABSTRACT

A process is provided for manufacturing groundwood pulp of uniform quality by maintaining a high and uniform moisture content in the wood in the grinding zone which comprises grinding debarked wood logs or wood chips in a closed pocket grinder under atmospheric or superatmospheric pressure while applying shower water both to the free surfaces of the grindstone and to the grinding zone where the logs or chips are in contact with the grindstone, such as by spraying the water at the end portions of the logs or chip mass, optionally together with applying shower water via the ram plates and a water trap arranged around the lower part of the log pockets, and preferably retaining shower water within the grinding zone by filling with shower water the hollows between the logs or chips located nearest the surface of the grindstone.

12 Claims, 3 Drawing Figures

PROCESS FOR MANUFACTURING GROUNDWOOD PULP WHILE MAINTAINING A HIGH AND UNIFORM MOISTURE CONTENT IN THE WOOD IN THE GRINDING ZONE

This is a continuation of application Ser. No. 281,433 filed July 8, 1981, now abandoned.

Groundwood pulp is normally produced from debarked logs. According to U.S. Pat. No. 4,247,363, patented Jan. 27, 1981, to Soma et al, it is also possible to produce groundwood pulp from wood chips. The wood material is thrust against a rotating grindstone where the abrasive action loosens and releases the wood fibers in the surface of the wood against the grindstone in a grinding mill, which may operate at atmospheric pressure or at superatmospheric pressure.

The process generates heat, and the wood fibers tend to stick to the grindstone, so during grinding of the logs the grindstone surface is cooled and cleaned by spraying shower water onto the surface. This shower water may optionally contain bleaching chemicals. The shower water normally is applied directly onto the free surfaces of the grindstone, in the direction of rotation of the grindstone and/or in the opposite direction thereto, at an angle of about 90° to the suspension and drive shaft of the grindstone. Since the logs brought into contact with the grinding surface lie parallel to the shaft of the stone, the shower water is applied at an angle of about 90° to the long axis of the logs.

The fibers freed from the logs during the grinding operation are collected together with shower water in the bottom pit or dam of the grinding mill. The pulp concentration in the resultant groundwood pulp suspension is normally between 0.5 and 2% calculated as bone dry pulp.

When groundwood pulp is ground using stone grinders, the wood is dried locally by the frictional heat generally by contact of the wood with the grinding surface of the stone. If the wood has a low moisture content, the wood may even become overheated, and subjected to thermal degradation. As the moisture content of the wood decreases, the temperature at which the lignin softens increases, which results in a pulp having relatively short fibers. Such pulps when used for paper manufacture give a paper having, among other things, a low tear strength. The magnitude of these effects and therefore the quality of the resultant groundwood pulp varies with the moisture content of the wood.

Moreover, the grinding of wood having a low moisture content can give such a high temperature at the grinding surface (the area in which wood and grindstone are in surface contact with each other) that the fibers become discolored, which results in a pulp of low brightness, and, furthermore, in a high consumption of chemicals in any subsequent bleaching.

Thus, in the grinding of wood while spraying shower water tangentially to the grindstone, it is difficult to obtain a strong and light pulp of uniform quality, because it is difficult to obtain wood starting materials having a high and uniform moisture content.

These difficulties are resolved by the process of the present invention, which relates to a method for manufacturing groundwood pulp from lignocellulosic material, in which wood pulp debarked in a known manner or wood chips are ground in a closed pocket grinder at atmospheric pressure or at a superatmospheric pressure by spraying shower water onto the free surfaces of the grindstone at an acute angle, and, in addition, applying shower water to the grindstone within the area where the wood and the grindstone are in surface contact with each other, i.e., to the grinding surface, and to portions of the wood charge located immediately above the surface of the grindstone, preferably at an angle within the range from about 0° to about 60°. These are collectively referred to herein as the "grinding zone". A "pocket grinder" is a grinder in which the wood is pressed against the grindstone from radially arranged wood pockets.

This method of applying shower water to the grinding zone of the logs or chips has surprisingly been found to prevent undesirable drying of the wood in the course of the frictional heating resulting from its being thrust against the surface of the grindstone, and thus holds the moisture content of the wood at any desired high and uniform level.

It has been found particularly advantageous to introduce the shower water to one end portion or to both end portions of the logs, and to direct the shower water in substantially parallel alignment with the longitudinal axis of the logs and at an angle within the range from about 0° to about 60°. In this way, the hollows between adjacent logs are also filled with shower water, which actively contributes to maintaining a high and uniform level of moisture in the wood in the grinding zone.

When introducing the shower water to the end portions of the logs or to wood chips, it has also been found particularly suitable to arrange a water trap at the lowermost part of each wood pocket. Such a water trap may suitably comprise plates or like elements located at the two plane ends and sides of the grindstone, and other plates connected with the plane ends and side plates arranged around each wood pocket, in a manner such as to hold the shower water within the grinding zone of the logs or chips to the greatest possible extent, and thereby making it possible to fill with water into the hollows located between the logs or chips situated nearest the surface of the grindstone at each stage of a grinding operation.

The shower water is suitably introduced into the grinding zone of the logs or chips via spray pipes and through holes made in said pipes or through nozzles fixedly mounted on the pipes, it having been found that the shower water should be maintained at a superatmospheric pressure within the range from about 0.5 to about 40 kp/cm$^2$, preferably from about 5 to about 30 kp/cm$^2$. The shower water pipes, together with the aforementioned holes or nozzles, can be fixedly mounted on the grinder or can be arranged for oscillatory movement. The shower water can be applied continuously or intermittently at intervals of from five to ten seconds. The spacing between the peripheral surface of the grindstone and the nearest spray delivery point above that surface should be greater than 10 mm.

When it is said that the shower water is applied "substantially in parallel with the longitudinal axis of the logs or chip mass" it is meant that the central portion of the spray projected straight out of the holes or nozzles strikes the surfaces of the logs or chips at an angle within the range from about 0° to about 60°, preferably between 0° and 15°, to the longitudinal axis of the logs or chip mass.

In addition to supplying shower water via spray pipes the shower water can also be applied to the logs or chips from above through openings or nozzles arranged in each ram plate. This actively contributes to filling the hollows between the lowermost adjacent logs or chips located nearest the surface of the grindstone, and assists in maintaining a desired high and uniform level of moisture in the wood in the grinding zone.

The flow of shower water to the logs or chips from all sources is suitably so controlled that the water introduced directly into the grinding zone is at a rate within the range from about 50 to about 600 liters/minute, for each ton of pulp produced per hour. Totally, thus, the rate of application of shower water per ton of pulp per hour may vary between 100 and 2000 liters/minute (including the shower water applied to the free surfaces of the grindstone).

It has been found of particular advantage to use filtered shower water, by filtering the shower water through suitable means such as a curved screen, a drum filter, a centrifuge, or a special filter. Thus, for example, shower water which has been ultrafiltered can be used to particular advantage.

The temperature of the shower water introduced to the grinding zone should be within the range from about 65° to about 120° C., preferably from 80° to 105° C., this latter range having been found particularly advantageous.

The method of applying shower water in accordance with the invention makes it possible to produce groundwood pulp which is stronger and brighter and of more uniform quality than groundwood pulp produced in accordance with the conventional shower water application methods. A further important advantage is that high quality groundwood is produced from aged wood, which has been stored, and has a low moisture content. During the method of the invention drying of the wood during the grinding process is substantially entirely prevented, thereby greatly decreasing the risk of harmful overheating. This also greatly increases the useful life span of the grindstone, and above all reduces the risk of damage to the grindstone, which is of significant importance, since a damaged grindstone normally results in a drop in production with associated economic losses. Another advantage is that the pulp produced is brighter, due to the fact that the fibers are not discolored by local overheating in the grinding zone.

A further advantage afforded by the invention is that the flow of shower water can be distributed within the grinder more uniformly which makes it possible to reduce the total amount of shower water required. This reduction in the flow of shower water results in a higher pulp consistency in the resultant groundwood pulp suspension. This is of particular advantage when the pulp is to be stored in a tower subsequent to leaving the grinder, since the tower can then be made relatively smaller.

A further advantage afforded by a higher pulp consistency is that it is cheaper to dewater the pulp suspension prior to drying, as well as prior to any subsequent bleaching stage. If subsequent bleaching of the pulp is desired, bleaching can be effected to advantage in accordance with the method described in U.S. Pat. No. 4,160,693, patented July 10, 1979, to Lindahl et al.

Groundwood pulp produced in accordance with the invention has a high content of long and flexible fibers, which produce a strong paper. Alternatively, this property can be utilized in the manufacture of paper having a lower grammage than normal while retaining good mechanical strength properties. Further, when mixed with chemical pulp, such as sulphate pulp, or sulphite pulp, the pulp manufactured in accordance with the invention can be utilized in greater quantities than normal, thereby reducing the cost of manufacturing paper. The groundwood pulp is also suitable for the manufacture of paper of a wider and more varying quality range than is normal for pulps with a yield within the range from 92 to 98%. This is due to the high degree of brightness of the resultant pulp, and its high percentage of long fibers.

FIG. 1 is a cross-sectional view of a grindstone which is sprayed with shower water in the conventional way, with the shower water directed at an acute angle onto the free surfaces A and B of the grindstone from four locations;

Figure 1:
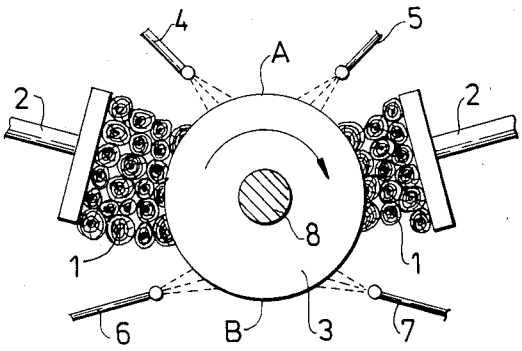
FIGS. 1 to 3 illustrate schematically the conventional water spraying technique in the grinding of wood to produce groundwood pulp, and also the method according to the invention.
Figure 2:
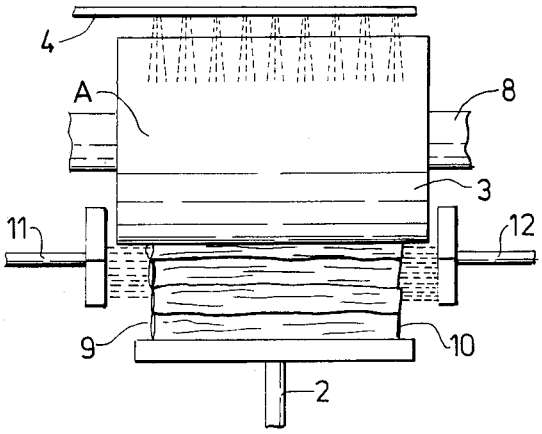
Figure 3:
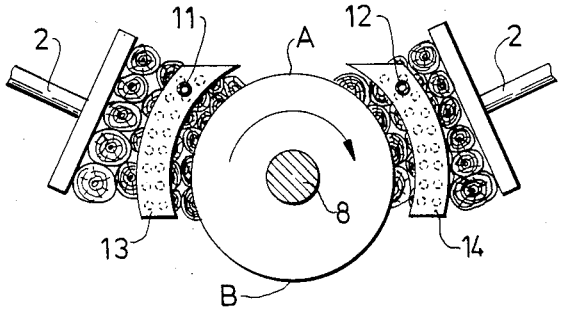

FIG. 2 is a top plan view of a grindstone similar to that shown in FIG. 1, where in addition to directing shower water directly onto the free surfaces of the grindstone, shower water is also supplied in accordance with the present invention; and FIG. 3 is a schematic cross-sectional view of a grinder in which shower water is supplied in accordance with the present invention, with the conventional supply of shower water onto the free surfaces of the grindstone omitted, in order to illustrate more clearly the method according to the invention.

In the system illustrated in FIG. 1, debarked logs 1 having a moisture content of between 20 and 65% are pressed heavily against the grinding stone 3 by means of rams 2, at a ram pressure of from 4 to 40 kg/cm$^2$.

The grinder is enclosed and atmospheric pressure or a superatmospheric pressure up to 10 kp/cm$^2$ above atmospheric is normally maintained. During the grinding operation, shower water is supplied via pipes 4,5,6 and 7, and is applied to the free cylindrical surfaces A,B of the grindstone at acute angles, but at right angles to the suspension and driveshaft 8 of the grindstone.

In the preferred embodiment of the invention shown in FIGS. 2 and 3, shower water is also sprayed onto both ends 9, 10 of the logs from spray pipes 11, 12 having nozzle-equipped spray headers 13 and 14 (see FIG. 3). The shower water is directed substantially in parallel with the longitudinal axis of the logs, i.e., at an angle of 0°, but can be applied to an angle up to 60°, and preferably not exceeding 15°.

The shower water sprayed onto the free cylindrical surfaces A, B of the grinding stone normally is at a superatmospheric pressure within the range from about 0.5 to about 30 kp/cm$^2$ above atmospheric, while the shower water introduced to the grinding zone is at a superatmospheric pressure within the range from about 0.5 to about 40 kp/cm$^2$ above atmospheric, preferably between 5 and 30 kp/cm$^2$ above atmospheric pressure.

The process of the invention is applicable to any kind of wood. In general, softwood such as spruce and pine can be ground more easily than hardwood such as beech and oak, but both types of wood can be ground satisfactorily using this process. Exemplary hardwoods which can be ground include birch, beech, poplar, cherry, sycamore, hickory, ash, oak, chestnut, aspen, maple, alder and eucalyptus. Exemplary softwoods include spruce, fir, pine, cedar, juniper and hemlock.

The wood can be in the form of logs, or large pieces, or even in small form, such as wood chips having dimensions that are conventionally employed in pulping processes. Wood slivers and splintors, wood granules and wood chunks, and other types of wood fragments can also be used.

The groundwood pulp that is obtained in accordance with the process of the invention can easily be bleached in accordance with known methods by treatment with chlorine, chlorine dioxide, chlorite, hypochlorite, peroxide, peracetate, oxygen or any combinations of these bleaching agents in one or more bleaching sequences as described in, for example, U.S. Pat. No. 4,160,693, patented July 10, 1979 to Lindahl, particularly column 3, lines 32 to 48, inclusive.

Preferred embodiments of the invention are illustrated in the following working Examples, in conjunction with controls carried out in accordance with the conventional spraying technique.

EXAMPLE 1

This Example illustrates the manufacture of unbleached groundwood pulp from debarked spruce logs, the method according to the invention being compared with a Control using the conventional method of applying shower water solely to the free surfaces of the grindstone (Control 1).

In the Example according to the invention, shower water in addition was introduced to the grinding zone by spraying at the ends of the logs. This was done by fitting one of nine pocket grinders in a groundwood pulping plant with spray pipes supplying shower water at right angles to the end portions of the logs, in accordance with the method illustrated in FIGS. 2 and 3.

Debarked spruce logs having an average moisture content of 53% were charged to the grinder. The logs were pressed against the surface of the grindstone at a pressure of 9 kp/cm$^2$. At this ram pressure, the mean power of the motor driving the grindstone was found to be 1950 kW. The logs were ground at atmospheric pressure, but the grinder was well sealed, to prevent the loss of water vapor formed by friction of the wood against the grindstone. The groundwood pulp suspension obtained was discharged from the grinder through a closed conduit. A suction fan was connected to the conduit in order to recover water vapor and other gases. The fan conveyed the hot vapors to a heat exchanger in which air was heated from a temperature of about +5° C. to about 40° C. This preheated air was used for flash-drying of the groundwood pulp.

In the Example according to the invention, the temperature of the shower water was 80° C. Shower water was applied to the free surfaces of the grindstone at a rate of 800 l/minute under a super-atmospheric pressure of 9 kp/cm$^2$ above atmospheric. Shower water was applied to the ends of the logs in the grinding zone at a super-atmospheric pressure of 12 kp/cm$^2$ above atmospheric and a rate of 300 l/minute. Thus, the total amount of shower water supplied was 1100 l/minute. Samples of the resulting groundwood pulp suspension taken from the closed conduit had a pulp consistency of 2.72%. These pulp samples were screened in a laboratory screen having a slot width of 0.15 mm, before being formed into sheets which were tested for paper properties. The average results from five samples are shown in Table I. In addition to pulp and paper properties, the Table also shows the energy consumed.

Control 1

The same grinder as that used in Example 1 was used in this test, but with the supply of shower water to the pipes 11 and 12, FIGS. 2 and 3 stopped. Thus, in this case shower water was supplied only to the free surfaces of the grindstone. Shower water was applied at a rate of 1600 liters per minute and the discharge pressure was 9 kp/cm$^2$ above atmospheric. Samples of the resulting groundwood pulp suspension taken from the closed conduit had a pulp consistency of 1.87%. The pulp was treated in the same manner as that recited in Example 1, and the results are set forth in Table I.

TABLE I

| | Control 1 | Example 1 |
|---|---|---|
| Energy consumed when grinding, kWh/ton | 1085 | 1085 |
| Canadian Standard Freeness, ml | 145 | 150 |
| Long fiber content according to Bauer McNett (+30 mesh) % | 15 | 24 |
| Tensile index, Nm/g | 33 | 41 |
| Tear index, mNm$^2$/g | 3.6 | 5.1 |
| Density, kg/m$^3$ | 382 | 370 |
| Brightness according to SCAN, % | 61 | 63 |

As seen from the Table, the pulp produced in accordance with the invention (Example 1) has a surprisingly high content of long fibers. The long-fiber content of the pulp produced in accordance with the invention is 60% greater than that of conventional groundwood pulp (Control 1). It is particularly surprising that pulp produced in accordance with the invention has a substantially higher tear index. This increase in tear index is probably due to the high percentage of long fibers. It is also very surprising that the pulp produced according to the invention has such a high brightness. The reason for this may be that in the method according to the invention the temperature in the grinding zone is somewhat lower due to the more effective supply of cooling shower water to the logs as they are ground against the hot surface of the grindstone.

EXAMPLE 2

This Example illustrates the manufacture of groundwood pulp from spruce logs in accordance with the invention, with the addition of shower water containing bleaching waste liquor from a peroxide bleaching step. By way of comparison, groundwood pulp was also produced in accordance with the conventional technique with the addition of shower water, using water containing bleaching waste liquor (Control 2), as described in U.S. Pat. No. 4,029,543.

In the tests, the same grinder and grinding conditions were used as in Example 1, with the following differences.

In the Example according to the invention, the temperature of the shower water was 85° C. This shower water with its content of bleaching waste liquor had the following composition:

| | |
|---|---|
| Hydrogen peroxide | 0.53 g/l |
| $Na_2SiO_3$ (water glass) | 2.12 g/l |
| Diethylenetriaminepentaacetic acid (DTPA) | 0.08 g/l |
| Acetic acid | 0.94 g/l |
| Resin and fatty acids | 0.13 g/l |
| Measured pH | 8.4 |

Shower water was applied to the grindstone at a superatmospheric pressure of 10 kp/cm$^2$ above atmospheric and a rate of 900 liters/minute. Shower water was applied to the ends of the logs at a superatmospheric pressure of 12 kp/cm$^2$ above atmospheric, and a rate of 200 liters/minute. Thus the total volume of shower water supplied in this Example was 1100 liters/-minute. Samples of the resulting groundwood pulp suspension taken from the closed conduit had a pulp consistency of 2.85% (average value of five samples). The pulp samples were screened in a laboratory screen having a slot width of 0.15 mm, after which hand-made sheets were produced and tested for paper properties. The results of the analysis and the energy consumed are set forth in Table II.

Control 2

The same grinder as in Example 2 was used, but with the supply of shower water to the pipes 11 and 12 (FIGS. 2 and 3) stopped. Thus, in this case only the free surfaces of the grindstone were sprayed with shower water containing bleaching waste liquor. The shower water was charged at a rate of 1700 liters/minute, under a discharge pressure of 10 kp/cm$^2$ above atmospheric. The shower water had a temperature of 70° C. Samples of the resulting groundwood pulp suspension taken from the closed conduit had a pulp consistency of 1.65%. The pulp was treated in the same manner as that recited in Example 2. The results are set forth in Table II.

TABLE II

| | Control 2 | Example 2 |
|---|---|---|
| Energy consumed when grinding, kWh/ton | 1025 | 1025 |
| Canadian Standard Freeness, ml | 185 | 175 |
| Long-fiber content according to Bauer McNett (+30 mesh), % | 17 | 27 |
| Tensile index, Nm/g | 38 | 43 |
| Tear index, mNm$^2$/g | 3.9 | 5.4 |
| Density, kg/m$^3$ | 362 | 350 |
| Brightness according to SCAN, % | 68 | 72 |

As seen from the Table, the pulp produced in accordance with the invention (Example 2) has a very high brightness. Apparently a more effective bleaching is obtained with the aid of bleaching waste liquor, when the shower water is also supplied directly to the guiding zone. It may also be that the shower water supplied to the free surfaces of the grindstone has difficulty in penetrating between wood and grindstone in the grinding zone. Thus, the high brightness may have resulted from a slightly lower temperature in the grinding zone, and/or a more abundant supply of residual bleaching chemicals, originating from the bleaching waste liquor.

A significant advantage afforded by the present invention is that the pulp suspension from the grinder has a relatively high pulp consistency. If the pulp is to be bleached further, it is possible to directly dewater the pulp further to a higher pulp consistency with the aid of a relatively simple dewatering apparatus. In order to avoid a high fiber content in the white water when grinding in the conventional way, it is necessary, because of its low pulp consistency, to first thicken the pulp suspension on a filter, which is space-consuming, and requires a high investment cost.

EXAMPLE 3

This Example illustrates the manufacture of groundwood pulp from spruce logs having a low moisture content. The shower water used contained bleaching waste liquor. The electrical power input required during the grinding operation was measured to be 2000 kW. Groundwood pulp was also produced in the same grinder in accordance with the conventional method (Control 3) and with the same electrical power input.

The Example according to the invention was carried out in the following manner. Debarked spruce logs having an average moisture content of 35% were ground while supplying shower water containing the same chemical compounds as in Example 2 and Control 2. Shower water was applied to the free surfaces of the grindstone at a rate of 950 liters/minute under a superatmospheric pressure of 8 kp/cm$^2$ above atmospheric. Shower water was applied to the end portions of the logs at a rate of 100 liters/minute and a superatmospheric pressure of 10 kp/cm$^2$ above atmospheric. The temperature of the shower water was 90° C.

Pulp samples were taken from the closed conduit and screened in a laboratory screen having a slot width of 0.15 mm, prior to forming sheets and testing for paper properties. The results obtained from the tests and the amount of energy consumed are set forth in Table III.

Control 3

In this Control, the same grinder was used as in Example 3, with the same electrical power input. Spruce logs having the same moisture content were used. The supply of shower water to the pipes 11 and 12 (FIGS. 2 and 3) was stopped. Thus, shower water was applied solely to the free surfaces of the grindstone as conventional. Shower water was charged at a rate of 1800 liters/minute under a discharge pressure of 8 kp/cm$^2$. The temperature of the shower water was 70° C.

Pulp samples were taken from the closed conduit and treated in the same manner as the samples obtained from Example 3. The results are shown in Table III.

TABLE III

| | Control 3 | Example 3 |
|---|---|---|
| Electrical energy consumed when grinding, kWh/ton | 1080 | 1030 |
| Canadian Standard Freeness, ml | 140 | 170 |
| Long-fiber content according to Bauer McNett (+30 mesh), % | 9 | 22 |
| Tensile index, Nm/g | 28 | 40 |
| Tear index, mMm$^2$/g | 3.3 | 4.8 |
| Brightness according to SCAN, % | 66 | 71 |

As seen from the Table, the strength values and brightness of the pulp produced in accordance with the invention are surprisingly high. This is very surprising in view of the low moisture content of the wood. It is also seen from the Table that when producing a groundwood pulp from wood having a low moisture content, the pulp obtained is much weaker when the shower water is supplied as in Control 2, solely in accordance with the known technique, i.e. directly onto the free surfaces of the grindstone.

Thus, an important advantage afforded by the present method is that groundwood pulp of high and uniform quality can be produced, even when the amount of moisture contained by the wood varies greatly.

Having regard to the foregoing disclosure the following is claimed as inventive and patentable embodiments thereof:

1. A process for manufacturing from wood logs groundwood pulp of uniform quality by maintaining a high and uniform moisture content in the wood logs in the grinding zone, which comprises grinding wood logs by thrusting the wood logs contained in at least one wood log pocket against the surface of a rotating grindstone in a pocket grinder while applying shower water both onto the free surfaces of the grindstone at an acute angle and directly into the grinding zone area where the wood logs in each pocket and the grindstone are in surface contact with each other and to the wood log charge located immediately above the surface of the grindstone at at least one end portion of the wood logs and in substantially parallel alignment with the longitudinal axis of the wood logs at an angle within the range from about 0° to about 60° while controlling the total flow of shower water so that the total volume of water introduced directly into the grinding zone is within the range from about 50 to about 600 liters/minute, for each ton of pulp produced per hour, in a sufficient amount to prevent drying of the wood logs in the course of the frictional heating resulting from their being thrust against the surface of the grindstone, and thus holding the moisture content of the wood logs at a high and uniform level.

2. A process according to claim 1, which comprises maintaining hollows between adjacent logs in each pocket filled with shower water.

3. A process according to claim 2 which comprises providing a water trap at the lowermost part of each pocket.

4. A process according to claim 3, in which the water trap comprises elements located at the two plane ends of the grindstone, and other elements connected with the end and side plates arranged around each pocket, in a manner such as to hold the shower water within the hollows between the logs in each pocket.

5. A process according to claim 1 in which the shower water is introduced into the grinding zone via spray pipes and through holes made in said pipes.

6. A process according to claim 1 in which the shower water is introduced into the grinding zone via spray pipes and through nozzles mounted on the pipes.

7. A process according to claim 6 in which in addition to supplying shower water via spray pipes, the shower water is also applied to the logs from above through openings or nozzles arranged in each ram plate of each pocket.

8. A process according to claim 1 in which the shower water is maintained at a superatmospheric pressure within the range from about 0.5 to about 40 $kp/cm^2$ above atmospheric.

9. A process according to claim 1 in which the total amount of shower water supplied per ton of pulp per hour is within the range from about 100 to about 2000 liters/minute, including the shower water supplied to the free surfaces of the grindstone.

10. A process according to claim 1 in which the shower water is filtered before application to the grindstone and wood.

11. A process according to claim 1 in which the temperature of the shower water is within the range from about 65° to about 120° C.

12. A process according to claim 1 in which the temperature of the shower water is within the range from about 80° to about 105° C.

* * * * *